United States Patent [19]

Bachmann et al.

[11] 4,083,811

[45] Apr. 11, 1978

[54] LANTHANATED THERMIONIC CATHODES

[75] Inventors: Robert Bachmann, Dottingen; Charley Buxbaum, Baden; Gernot Gessinger, Niederrohrodorf, all of Switzerland

[73] Assignee: BBC Brown, Boveri & Company, Limited, Baden, Switzerland

[21] Appl. No.: 486,396

[22] Filed: Jul. 8, 1974

[30] Foreign Application Priority Data

Jul. 9, 1973 Switzerland ..... 9940/73

[51] Int. Cl.[2] ..... H01B 1/06

[52] U.S. Cl. ..... 252/509; 252/503; 252/515; 252/516; 313/346 R; 313/346 DC; 252/504

[58] Field of Search ..... 252/503, 504, 509, 512, 252/515, 516, 521; 313/346 R, 346 DC

[56] References Cited

U.S. PATENT DOCUMENTS 2,438,732 3/1948 Williams ..... 252/503

FOREIGN PATENT DOCUMENTS 929,668 6/1963 United Kingdom.

OTHER PUBLICATIONS

Metals and Materials, vol. 1, 1967, Albert., No. 2, p. 44.

C. W. Horsting Journal of Applied Physics, vol. 18, pp. 95-102.

*Primary Examiner*—Benjamin R. Padgett

*Assistant Examiner*—Josephine L. Barr

*Attorney, Agent, or Firm*—Werner W. Kleeman

[57] ABSTRACT

A thermionic cathode of tungsten or molybdenum is made with an activating content of lanthanum oxide and is supplied with a carbonaceous reducing agent either by incorporation in the bulk material of the cathode body or by carburizing, so that the reducing agent comprises at least in part a carbide of the carrier metal. Lower operating temperatures and higher emissivity are obtained compared to thoriated tungsten filaments and longer useful life compared to other cathodes activated by other rare earth oxides. The temperature-emissivity characteristics are such that good results are obtainable even within the temperature range in which molybdenum is usable as a carrier material.

20 Claims, 3 Drawing Figures

LANTHANATED THERMIONIC CATHODES

This invention concerns thermionic cathodes. In particular, it relates to cathodes for electron tubes that are made with a carrier material of highmelting metal and an activating material comprising the oxide of a rare earth metal and a reducing agent that reacts with the oxide of the rare earth metal under thermionic operating conditions. The invention also includes a method for manufacturing such a cathode.

Oxide cathodes have already been proposed (see Metals and Materials, Vol. 1, 1967, No. 2, p. 44) having a carrier of tungsten, tantalum or molybdenum and an activating material comprising the oxide of a rare earth metal and a reducing agent. In such cathodes the activating material is applied to the cathode body as an oxide layer or by impregnation in the bulk of the cathode body, and titanium hydride or zirconium hydride is to be used as the reducing agent. Such cathodes operate by the liberation of the rare earth metal by reduction and the formation of an emitting monatomic layer on the cathode surface. The cathodes have been found virtually unusable from a practical standpoint, however, because on the one hand only comparatively small emission current densities, of the order of 1.5 $A/cm^2$, are obtainable under optimum temperature conditions and, on the other hand, a rapid exhaustion of the emission capabilities is to be expected.

With respect to the present state of the art, the conventional thoriated tungsten cathodes are also to be mentioned, which are distinguished by a long useful life with moderate emission current densities, but, however, with a high operating temperature of about 2000° C and a corresponding specific heat and dissipation of, for example, 35 $W/cm^2$ of cathode surface providing correspondingly small electron yield as referred to the heating power, for example 90 mA/W. These cathodes also, accordingly, leave a great deal of room for improvement in this regard.

It is an object of the present invention to provide a thermally excited cathode, which is to say a so-called thermionic cathode, capable of providing a greater electron yield for a given heat dissipation, at lower operating temperature and specific heat consumption, while at the same time having an adequate useful life.

SUBJECT MATTER OF THE PRESENT INVENTION

Briefly, the activating material of the cathode contains lanthanum oxide and the reducing agent provided is composed at least in part of carbon. The active cathode body is provided preferably with between 0.2 and 5% by weight of lanthanum oxide as one component. The range of lanthanum oxide content in the cathode composition is more preferably from 0.7% to 4% and it is still further preferred to limit the lanthanum content to not more than about 2% in order to avoid difficulties in the shaping of the cathode, but to maintain the lanthanum oxide content close to 2%, since the larger lanthanum content favors good emission performance and useful lifetime.

It has been found particularly advantageous to use a reducing agent composed at least in part of the carbide of a high-melting metal, preferably a high-melting metal that is also a component of the cathode body that is the carrier for the emission surface.

The carrier material may be any of those heretofore used for thermionic cathode bodies, and are generally referred to herein as "high-melting" metals. Among them are principally tungsten, molybdenum and tantalum.

Experiments have shown that with cathodes of the present invention substantially increased emission current densities and specific electron yields may be obtained at lower operating temperatures, and with equivalent, and in any event sufficient, useful operating life, as compared with the values obtainable with the already highly developed thoriated tungsten cathodes. The obtainable improvement is typically about 30% for emission current density and, notably, about 100% for the specific electron yield, assuming that in both cases a tungsten carrier material is used.

Although the utilization of a tungsten carrier in the cathode of the present invention thus already provides a substantial advance, a preferred embodiment of the invention envisages the use of molybdenum as a carrier material, in which case still better results are obtainable. In such an improved embodiment of the invention there are obtained emission current densities of up to 8 $A/cm^2$ for continuous (steady state) operating conditions and of substantially still higher values for short-period loads, going up to about 15 $A/cm^2$, and specific electron yields of up to 240 mA/W. By comparison with the optimum values for thoriated tungsten cathodes, it is thus possible to count on the following levels of improvement for the typical case: heating power consumption reduced to about one third for the same emission, maximum emission raised by a factor of about 2.7, and emission generally raised by a factor of 4 to 5 at the same operating temperature, which temperatures, however, are limited to about 1800° K because of the lower melting point of molybdenum. In view of the named values, the operating temperature can readily be held lower than 1800° K with a still greater degree of relative improvement over the thoriated tungsten case.

The lower operating temperature and activation temperature of the carbon-reduced lanthanated lanthanum cathodes of the present invention, compared to thoriated cathodes, moreover, is the basis for the now possible utilization of molybdenum as the carrier material and likewise as the carbide forming constituent in the reducing agent, which leads not only to the better emission behavior already mentioned, but also to greater advantages for the mechanical aspects of cathode manufacture, on account of the higher ductility compared to that of tungsten.

The manufacture of the cathode body by high temperature sintering under pressure is particularly advantageous. This method of manufacture can be applied to the extent of producing a density up to a value in excess of 90% of the theoretical density without employment of the emission mechanism of the device while obtaining correspondingly desirable mechanical properties. Cathode bodies can also be produced in wire or sheet form with the usual methods of extrusion, rolling and the like.

The emission mechanism of the cathode having the characteristics above outlined is based on the fact that lanthanum oxide in the region near the surface of the cathode is reduced by the reducing agent and forms a highly emissive monatomic layer on the cathode surface. The supply of lanthanum to compensate for the lanthanum losses caused by vaporization takes place by diffusion of lanthanum oxide from the inner regions of the cathode towards the surface region, where the reduction takes place. The kinetics of the process are favorably affected in the case of reduction by a carbide, which has already been mentioned as preferred, and is advantageous with regard to providing a long useful life for the cathode with only a slight and uniform falling off of the emission. The diffusion mechanism here again significantly participates in the control of the supply of lanthanum. A fine grained structure with a correspondingly high volume proportion of grain boundary zones has been found particularly advantageous, from which it can be concluded that the diffusion along the grain boundaries provides a favorable effect in contrast to the slower diffusion within the bulk of the grains.

It is accordingly advantageous to reduce the components of the carrier and activation materials to powder form in the course of manufacture.

A preferred embodiment of the cathode of the present invention takes account of the foregoing data by providing a higher concentration of the carbonaceous reducing agent in the outer zone of the cathode, compared to the interior of the cathode. Although in principle elementary carbon itself comes into consideration as an effective component of the reducing agent, the carbide reaction has been found particularly advantageous and carbides are accordingly preferred. The cathode can therefore be so constituted that the concentration of the high-melting metal is distributed substantially uniformly over the cathode cross-section, whereas in a peripheral zone of the cathode at least one high-melting metal is present at its carbide. It follows, therefore, that surface carburizing of a substantially homogeneous cathode body is a method of manufacture that offers some advantages. The cathode body in this case consists of one or more high-melting metals with a preferably homogeneous doping of a lanthanum-containing activating material.

It is appropriate to take special precautions to prevent substantial grain growth, especially during the phases of the manufacturing process that are carried out at raised temperatures, particularly during a carburizing step and subsequent activation. For this purpose the addition of grain growth inhibitors such as potassium, aluminum and/or silicon compounds have been found useful. For example nitrates of aluminum and potassium are useful for this purpose, as are also the corresponding carbonates and chlorides. Colloidal silicon oxide is also effective as a grain growth inhibitor. The grain growth inhibitor is provided in small relative quantities, generally less than 0,5% by weight of the cathode material and typically in an amount that is about 0,1% of the cathode material.

Any of the common methods of carburization are in principle applicable to the production of cathodes according to the present invention. These standard procedures may be found in articles by C. W. Horsting, Journal of Applied Physics, Vol. 18, p. 95 102 (January 1947) and R. O. Jenkins, Vacuum, Vol. 19, No. 8, p. 353–359 (January 1966).

In view of the fine grain structure desired for the cathode it has further been found effective to proceed to the manufacture of cathodes by producing granulates by powder metallurgy that have a grain size of at most 5 microns. It is particularly advantageous to keep the average grain size in the region between 0.5 and 1 micron.

The invention is further described by way of example with reference to the accompanying drawings, in which diagrams are provided showing the emission current density Ge over the range of operating temperatures T.

Figure 1:
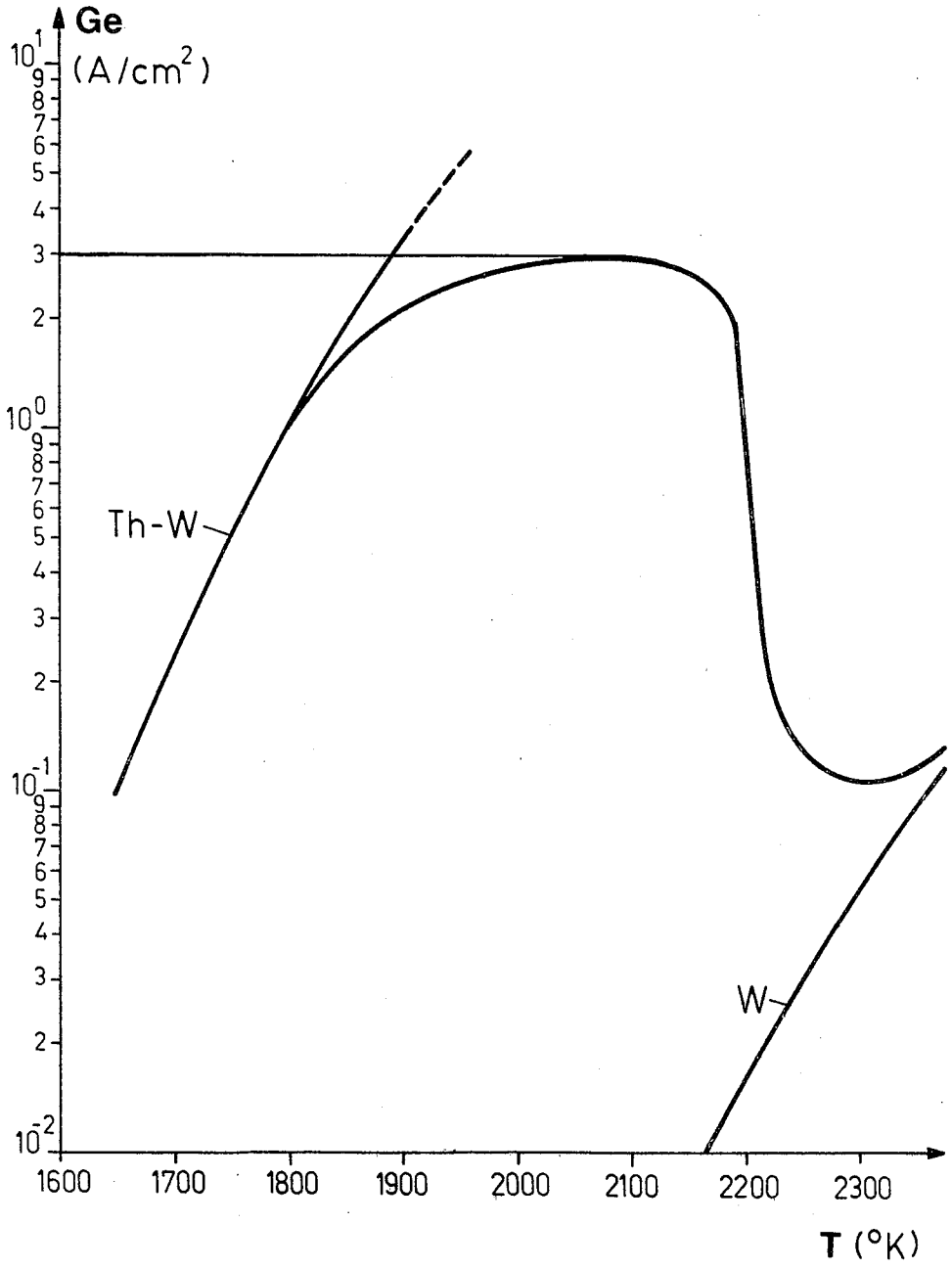
FIG. 1 shows, as a basis of comparison, the emission curve of a conventional thoriated tungsten cathode.

As shown in FIG. 1, the maximum obtainable steady state emission current density for a conventional thoriated tungsten cathode amounts to about 3 mA/cm$^2$ and this is obtained at a temperature of about 2100° K. At higher temperatures there is a falling off of the emission, down to the curve that holds for pure tungsten.

Figure 2:
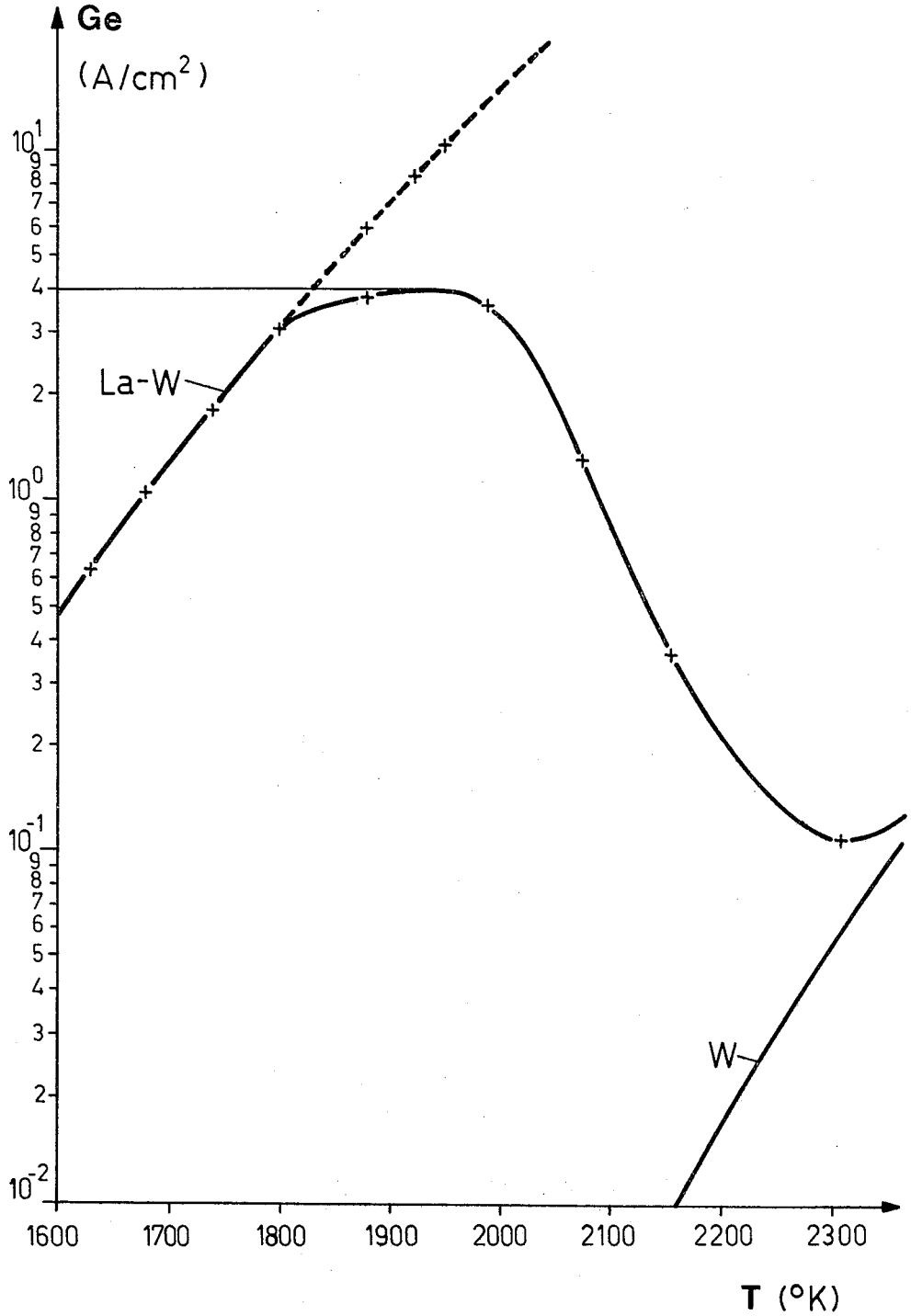
FIG. 2 shows the corresponding emission curve of a lanthanated tungsten cathode according to the present invention.
Figure 3:
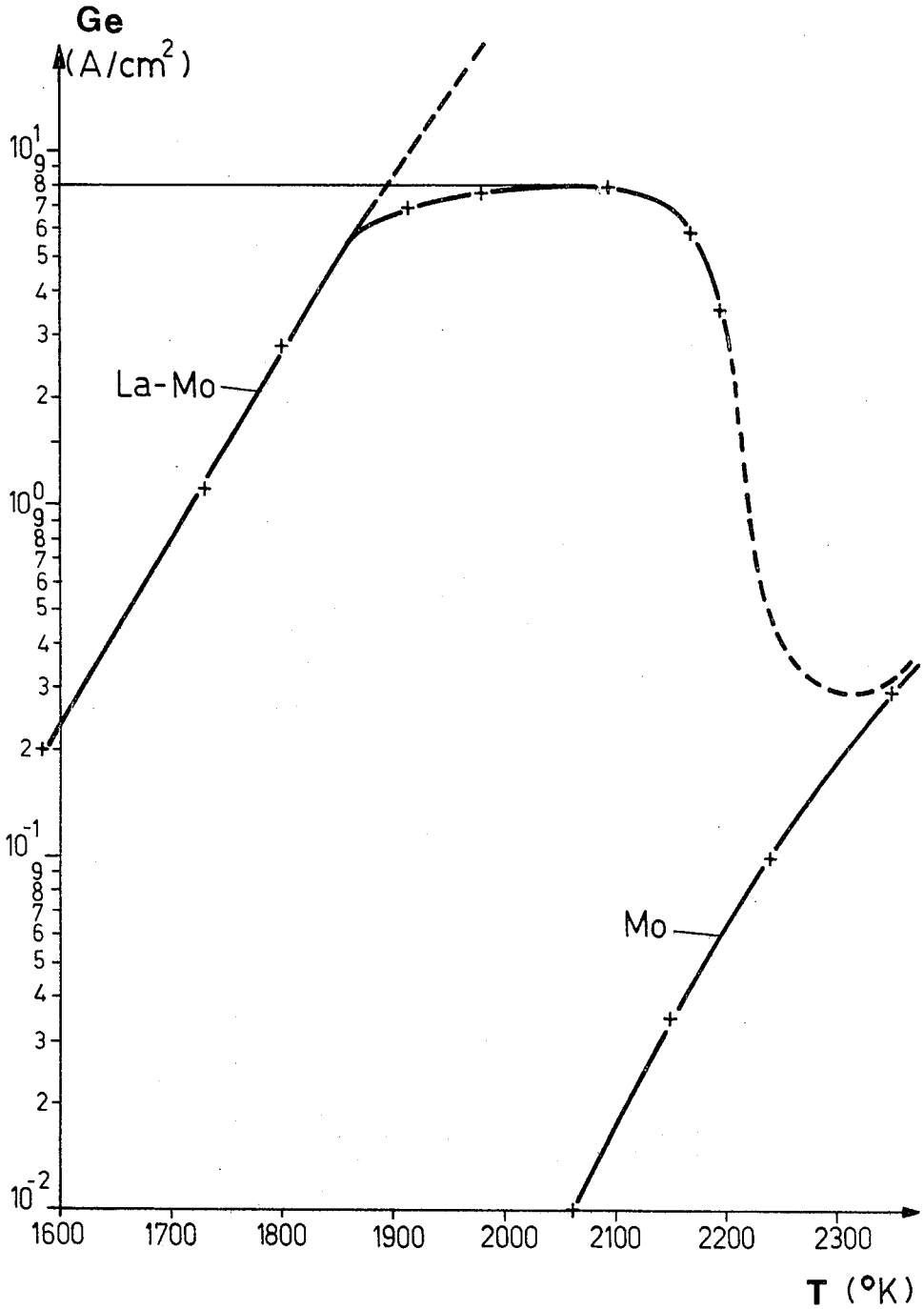
FIG. 3 shows the corresponding emission curve of a lanthanated molybdenum cathode according to the present invention.

FIGS. 2 and 3 show the respective emission curves of two examples of cathodes according to the present invention.

EXAMPLE 1

Material from which cathodes are to be manufactured is prepared from 98% by weight of tungsten powder (grain size 0.5 microns) and 2% $La_2O_3$ powder of 99.99% purity dried out in heated air for thirty minutes at 800° C, mixed together. This powder mixture is pressed hot in a graphite mold under vacuum at 1600° C at a pressure of 250 atmospheres for 35 minutes, to produce a sample of 93% density (i.e. degree of compaction). From this sample individual cathodes are cut out which are polished and then carburized in a mixture of hydrogen and gaseous benzene.

Cathode plates produced in accordance with the above example were tested for their emission capability in a high vacuum planar diode configuration.

FIG. 2 shows the measured emission current density as a function of the temperature. Comparison with the corresponding curve for thoriated tungsten shown in FIG. 1 makes clear that for any desired value of emission, the cathode temperature of the lanthanated tungsten is lowered by 120° to 250° and, conversely, that the emission current density of lanthanated tungsten at 1750° K is four times as great as that of thoriated tungsten. The maximum stable emission amounts to 4 A/cm$^2$ at a temperature of 1900 K. The related electron yield, referred to the heating power, amounts to 170 mA/W and is hence approximately twice as high as that of thoriated tungsten. Going on from a steady state operation at 1800° K, the lanthanated tungsten cathode provides substantially higher emission from further short-period heating, for example upon heating to 950° K for about ten minutes, the emission is 9 to 10 A/cm$^2$.

EXAMPLE 2

The raw material in this case is composed of 98% molybdenum powder (grain size 0.5 microns) and 2% $La_2O_3$ powder heat dried for 30 minutes at 800° C in air (percentages are by weight and the $La_2O_3$ is 99.99% pure). This powder mixture is hot pressed in a graphite mold in vacuum at 1600° C at a pressure of 250 atmospheres for 35 minutes, to produce a body of 93% density. Small plates are cut from this body, polished and then carburized in a mixture of hydrogen and benzene vapor.

Cathode plates made in accordance with Example 2 above were tested for emissivity in a planar diode. FIG. 3 shows the measured emission current density as a function of the temperature for these $La_2O_3$ — Mo cathodes. Comparison with FIG. 1 shows that for any desired value of emission the cathode temperature of the lanthanated molybdenum is lower by 250° and, conversely, that the emission current density for lanthanated molybdenum at 1700° K is approximately fourfold that of thoriated tungsten. The maximum obtainable steady state emission amounts to 8 A/cm$^2$ at a temperature of 2050° K. The related emission current density, referred to the heating power, amounts to 240 mA/W and is therefore 2.7 times higher than that of thoriated tungsten. Proceeding from a steady state operation at 1800° K the lanthanated molybdenum cathode provides substantially higher emission upon further heating up for a short period, for example reaching 15 A/cm$^2$ upon heating at 1950° K for about ten minutes.

The compositions of the cathodes described in Examples 1 and 2 can be improved for manufacturing purposes by addition of a grain growth inhibitor as previously discussed. The control of grain growth has been thoroughly explored in tungsten technology particularly and is, in itself, well understood. A grain growth inhibitor allows for reducing grain size and enhance the overall grain boundary volume which is essential for the lanthanum supply by grain boundary diffusion which is the most effective kind of diffusion in the present invention.

Carburizing may under some conditions introduce elemental carbon in the cathode body in addition to forming one or more carbides. Alternatively, however, a carbide, or elemental carbon, or both may be incorporated, for example, as a dispersed powder in the mixture to be sintered into a cathode body.

In conclusion, it should be mentioned that the cathodes of the present invention are useful not only in the field of high-vacuum tubes, particularly in this case for high-power transmitting tubes, but also for gas discharge tubes such as metallic vapor lamps and the like, with substantial technical advantages.

I claim:

1. A thermionic cathode comprising a body surrounded by an emitting surface, said body consisting essentially of a high-melting metal, between 0.2% and 5% by weight lanthanum oxide distributed throughout said body and close to the emitting surface of said body and between 0.05% and 18% by weight of a carbon containing-reducing agent which is effective in reducing the lanthanum oxide to lanthanum during operation of the thermionic cathode and replenish the lanthanum which has evaporated at the emitting surface of the body.

2. The thermionic cathode as defined in claim 1, wherein the body prior to use of the thermionic cathode contains a lanthanum oxide content of approximately 2% by weight.

3. The thermionic cathode as defined in claim 1, wherein the carbon containing-reducing agent at least partially consists of a carbon containing compound.

4. The thermionic cathode as defined in claim 1, wherein the carbon containing-reducing agent at least partially consists of a carbide of a high-melting metal.

5. The thermionic cathode as defined as claim 1, wherein the carbon containing-reducing agent comprises elemental carbon.

6. The thermionic cathode as defined in claim 1, wherein the carbon containing-reducing agent is present in a greater concentration in an outer zone of said body near the emitting surface than in the remaining interior portion of said body.

7. The thermionic cathode as defined in claim 6, wherein the high-melting metal constituent of the body is distributed substantially uniformally throughout said body, and wherein at least one high-melting metal of such constituent is present in a zone of the body adjacent the emitting surface thereof in the form of the carbide of said high-melting metal.

8. The thermionic cathode as defined in claim 1, wherein the body at least partially consists of molybdenum constituting the high-melting metal.

9. The thermionic cathode as defined in claim 1, wherein the body at least partially consists of tungsten constituting the high-melting metal.

10. The thermionic cathode as defined in claim 1, wherein the body includes as a constituent thereof an inhibitor of the growth of the grain size of at least one of the other constituents of said body, said inhibitor being present in an amount not exceeding 0.5% by weight of the material of the body.

11. The thermionic cathode as defined in claim 10, wherein the grain growth inhibitor comprises a material selected from the group consisting of potassium salts, sodium salts, aluminium salts and silicon oxide materials.

12. The thermionic cathode as defined in claim 1, wherein the body is formed of a sintered material possessing a degree of compaction sufficient to render the same at least essentially free of pores.

13. A thermionic cathode consisting essentially of a body surrounded by a freely exposed emitting surface and containing dispersed throughout said body to a location near to the region of the emitting surface between 0.2% and 5% by weight lanthanum oxide and between 0.05% and 18% by weight of a carbon containing-reducing agent, said lanthanum oxide being reduced, during operation of the thermionic cathode, by the carbon containing-reducing agent to lanthanum in order to continually replenish lanthanum evaporating from the emitting surface of the body so as to maintain a substantially monatomic layer of lanthanum at the emitting surface of the cathode, said thermionic cathode possessing higher emissivity in comparison to a thoriated tungsten filament.

14. A method of producing a thermionic cathode comprising the steps of:

a. forming a cathode body of a metallic carrier material consisting essentially of at least one high-melting metal an activating material containing lanthanum oxide in an amount between 0.2% by weight and 5% by weight of said cathode body;

b. said lanthanum oxide being dispersed in said cathode body up to the region of the outer surface of said cathode body; and c. subjecting the body so formed to carburization to introduce therein a carbon-containing reducing agent in an amount between 0.05% and 18% by weight.

15. The method as defined in claim 14, wherein the content of lanthanum oxide of the body subjected to carburization is between 0.7% by weight and 4% by weight.

16. The method as defined in claim 15, wherein the content of the lanthanum oxide of the body subjected to carburization amounts to approximately between 2% by weight and 3% by weight of the cathode body.

17. The method as defined in claim 14, wherein the step of forming said cathode body includes sintering a granular mixture having a grain size which does not exceed 5 microns.

18. The method as defined in claim 17, wherein the step of sintering the granular mixture is carried out under pressure.

19. The method as defined in claim 17, wherein the starting material for the sintering step comprises a granular material having an average grain size between 0.5 and 1 micron.

20. The method as defined in claim 14, wherein the step of forming the body entails subjecting the body to pressing to an extent adequate for providing the body with a pore volume which does not exceed 10%.

* * * * *